US006808150B1

(12) United States Patent
Roetenberg

(10) Patent No.: US 6,808,150 B1
(45) Date of Patent: Oct. 26, 2004

(54) SUSPENSION SYSTEM AND PRODUCT HOLDER FOR PRODUCTS

(76) Inventor: Paulus Gerardus Roetenberg, Pro-Innovations BV, Postbus 251 - 7570 AG, Oldenzaal (NL)

( * ) Notice: Subject to any disclaimer, the term of this patent is extended or adjusted under 35 U.S.C. 154(b) by 0 days.

(21) Appl. No.: 09/718,761

(22) Filed: Nov. 22, 2000

(30) Foreign Application Priority Data

Nov. 22, 1999 (NL) ..... 1013634

(51) Int. Cl.[7] ..... A47H 1/10

(52) U.S. Cl. ..... 248/317; 211/94.01; 211/162; 248/339

(58) Field of Search ..... 248/317, 324, 248/339, 303, 304, 341; 211/124, 105.3, 162, 94.01, 94.02

(56) References Cited

U.S. PATENT DOCUMENTS 1,132,190 A * 3/1915 Kohout ..... 211/94.01 X
1,388,132 A * 8/1921 Walp et al. ..... 248/341
1,637,047 A * 7/1927 Moore ..... 248/341
4,771,899 A * 9/1988 Benedict et al. ..... 211/94.01 X
5,372,346 A * 12/1994 Upchurch et al. ..... 248/304
5,960,967 A * 10/1999 Neil ..... 211/94.01

* cited by examiner

*Primary Examiner*—Ramon O Ramirez
(74) *Attorney, Agent, or Firm*—McDonnell Boehnen Hulbert & Berghoff LLP

(57) ABSTRACT

A suspension system for products comprises a base (1) for fixing to a wall of a space, provided with at least one product holder (10). On a first side the product holder is connected displaceably to the base (1) and on a second side comprises a suspension member (14,15) which is able to receive a product. The base comprises at least two mutually telescopic profiles (2,3), wherein on the first side the product holder is connected to at least one of the profiles not only displaceably but also for rotation on a longitudinal axis (L).

8 Claims, 2 Drawing Sheets

SUSPENSION SYSTEM AND PRODUCT HOLDER FOR PRODUCTS

CROSS REFERENCE TO RELATED APPLICATIONS

This application claims the benefit of Dutch Patent Application No. 1013634, which was filed on Nov. 22, 1999.

BACKGROUND

1. Field of the Invention

The present invention relates to a suspension system for products comprising a base for fixing to a wall of a space, provided with at least one product holder which on a first side is connected displaceably to the profile and on a second side comprises a suspension member which is able to receive a product. The invention further relates to a product holder for such a suspension system.

2. Description of Related Art

In both the home and work situation it regularly occurs that products lie around for a long time which should really be stored away properly. The available storage space is however often insufficient and inadequate. An example in the home situation is for instance tools, and particularly gardening tools. These tools are often spread about in different places or placed together in a corner of a garage or shed, whereby the rearmost tools are difficult to reach. Diverse suspension systems, for instance for gardening tools, are commercially available per se, but these generally require a relatively large wall area which is not always available or only provides space for a limited number of the tools.

The present invention has for its object to provide a suspension system for products which has a relatively large storage capacity while occupying comparatively little wall space.

A suspension system according to the invention has the feature for this purpose that the base comprises at least two mutually telescopic profiles and that on the first side the product holder is connected to at least one of the profiles not only displaceably but also for rotation on a longitudinal axis. The invention is herein based on the insight that a particularly efficient suspension system can be achieved with the combination of an extending system with rotatable product holders. In the case of for instance gardening tools, these are placed in the system in an extended position of the system and then optionally turned such that the narrowest dimension of the tool lies in the profile direction. In this position the base is pushed in again so as to obtain the highest possible packing density. In order to remove the tools again, these steps can be followed in reverse sequence. It is thus possible that the thus suspended products cannot be removed immediately in the push-in position of the base, but this is still possible by extending the base and optionally turning the relevant product holder.

A particular embodiment of the suspension system has the feature according to the invention that the profiles are both provided with a cavity extending axially therein and have a cross-section of at least practically the same shape and that one of the profiles is arranged fitting displaceably in the cavity of the other profile. In this case both profiles are received telescopically in each other such that an exceptionally compact and robust entity is obtained. When telescoped, only the length of the outer profile is available and the suspended products are packed relatively tightly together. In order to remove the products, the inner profile can however be easily extended to thus lengthen the whole. This elongated position provides the possibility of spreading the suspended products over a greater length, so that a product is more readily accessible for removal. If desired, the product can herein be turned into the desired orientation with the product holder.

In a further particular embodiment the suspension system according to the invention is characterized in that the profiles comprise longitudinal slots which at least partly overlap each other and which provide access to the cavity, and that the product holder protrudes with a shank through the longitudinal slot of the at least one profile and on the first side comprises an anchoring member which is displaceably anchored in the cavity of the at least one profile. The product holders are herein received displaceably in the cavity of the at least one profile with the anchoring member. The displaceable anchoring provides the option of guiding the product holders at least axially through the cavity of the profile, while the product holders also allow rotation. Because the guiding of the product holders takes place in the profile and not for instance thereover, this moving part of the system is protected against dirt and sand and the like, which in the long term could otherwise adversely affect the displaceability of the product holders.

A preferred embodiment of the suspension system has the feature according to the invention that the anchoring member comprises a ball which is situated on an end of the shank of the product holder and which has a diameter greater than a width of the longitudinal slot. Such an anchoring member is not only relatively simple to realize, but simultaneously provides the product holder with both an axial freedom in the profile and a rotatability on its own axis. A further particular embodiment of the suspension system according to the invention is characterized herein in that the ball at least almost makes contact with at least two mutually opposite walls of the cavity, in order to thus limit the clearance of the ball in the profile to a minimum.

During use the ball slides constantly through the slot and the cavity of the profile. A possible protective layer on the ball may thereby wear quickly, whereby the material of the ball becomes exposed. With a particular eye to outdoor applications, a further preferred embodiment of the suspension system according to the invention has the feature that at least the ball of the product holder is manufactured from a corrosion-resistant material. Because at least the ball is thus manufactured from a corrosion-resistant material, it will nevertheless remain resistant to weather influences despite wearing through of a possible coating. Corrosion of the ball is hereby prevented, which not only enhances the appearance but, more importantly, furthermore ensures displaceability of the product holders for a long period.

In a pushed-in position of both profiles the product holder is anchored in the inner of the two telescopic profiles. In an extended position the product holder can however slide freely out of the cavity in the one profile into that of the other profile. In order to prevent a disturbing transition between the two profiles occurring here as a result of the wall thickness of the inner profile, a further preferred embodiment of the suspension system according to the invention has the feature that the longitudinal slot in at least the one profile comprises an oblique edge for receiving the ball of the product holder thereon. Since the ball herein lies on the oblique edge, it is possible to achieve that the, imaginary, underside of the ball lies at least practically at the height of the inner wall of the outer profile, even though the ball is situated in the inner profile. There will therefore occur no or hardly any disturbing transition or other interruption of the sliding movement of the ball in the two profiles.

In a further particular embodiment the suspension system according to the invention is characterized in that the product holder comprises a shoulder from which depend two at least practically congruent hooks. The product holders thus form as it were a claw which is found to be particularly suitable for practical storage therein of diverse types of household and gardening tools. A further preferred embodiment herein has the feature that the shoulder and the hooks have a rounding with at least practically the same radius of curvature. The choice of the same rounding for the should and the hooks offers particular advantages from a production engineering viewpoint, since only one production mould or other tool is thus required to make both roundings. The rounding of the shoulder moreover has the advantage that in a telescopic system as described above the product holders are less likely to protrude with the shoulder into the slot of the profiles, which could otherwise result in juddering and jolting of the axial movement. Finally, a uniform rounding is also especially attractive from an aesthetic viewpoint.

BRIEF DESCRIPTION OF THE DRAWINGS

The invention will now be further elucidated with reference to two embodiments and associated drawings. In the drawings.

The figures are drawn substantially schematically and not to scale. For the sake of clarity some dimensions in particular have been exaggerated. Corresponding parts are designated in the figures as far as possible with the same reference numerals.

Figure 1:
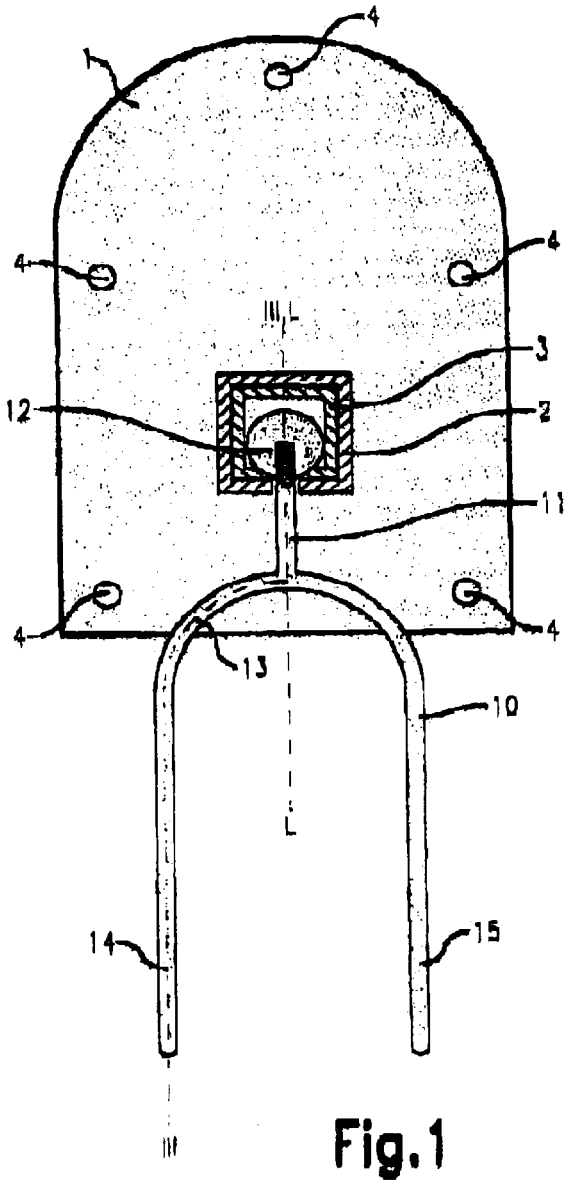
FIG. 1 shows a front view and cross-section of an embodiment of a suspension system according to the invention.

The suspension system shown in FIG. 1 comprises a base in the form of a wall plate 1 and a profile assembly 2,3 of two profiles with a cross-section of at least practically the same shape. An outer 2 of the two profiles 2,3 is herein connected firmly to the wall plate, while the inner profile is received freely displaceably but close-fittingly in the cavity extending axially in outer profile 2. A unit is thus obtained with two profiles which can extend mutually telescopically.

Both the wall place and both profiles are manufactured from steel, which guarantees a strong and durable whole which is resistant to a relatively high load. The outer profile is welded to wall plate 1 in order to obtain a connection without clearance. The wall plate is in turn provided with five bores 4 for receiving screw bolds therein, whereby the whole can be fixed rigidly to a wall of a space. Although the suspension system shown here is in principle suitable for all types of products, it is particularly suitable for handing and stowing away gardening tools, brooms and the like. The parts of the system 1,2,3 have a powder coating as finish, which not only provides an attractive appearance but also provides durable protection for the parts against corrosion.

Both profiles 2,3 comprise on their underside a slot 5,6 which extends through the whole wall thickness of a profile and thus provides access to the cavities in profiles 2,3. In both profiles 2,3 this slot extends practically in the middle of the profile over the whole length of the relevant profile, whereby both slots 5,6 overlap each other along the whole length of the system when the suspension system is fully pushed in. A shank 11 of product holder 10 having on the end an anchoring member 12 in the form of a ball extends via slots 5,6 into the cavities of profiles 2,3 in order to anchor product holder 10 therein in a manner which allows an axial travel in profiles 2,3 as well as a rotation on its own longitudinal axis L. A sealing cap 7 on the outer end of inner profile 3 prevents product holders 10 unintentionally falling out of profiles 2,3.

In this embodiment the product holders comprise a claw manufactured from steel wire of about 5 mm diameter with a shoulder 13 from which depend two practically congruent hooks 14, 15. FIG. 3 shows such a product holder in a cross-section along line III—III of FIG. 2. Shoulder 13 and hooks 14,15 all comprise a rounding with at lest practically the sane radius of curvature. Not only is this advantageous from a production engineering viewpoint, since only a single tool is thus required, it furthermore provides a restful appearance which is perceived as particularly attractive from an aesthetic viewpoint. Because of the rounded shoulder there is also less chance of a product holder protruding with the shoulder into the slot of the profile assembly, which could otherwise obstruct the sliding thereof.

Figure 2:
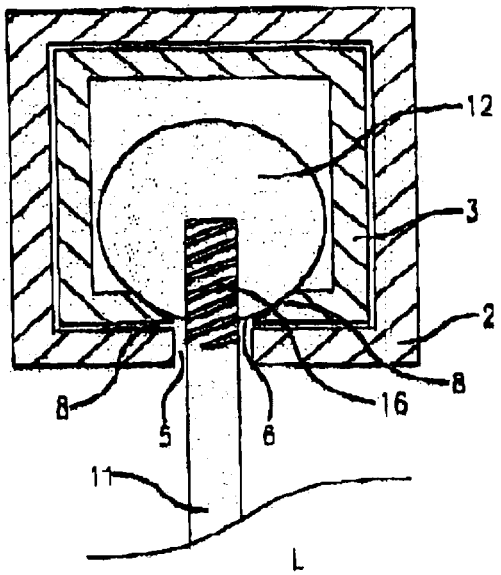
FIG. 2 shows a detail cross-section of the profile assembly as applied in the suspension system of FIG. 1.
Figure 3:
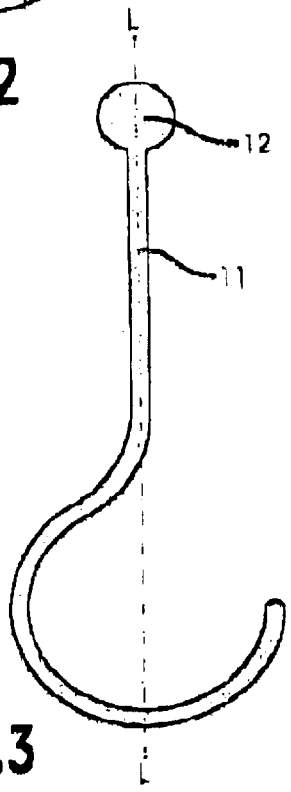
FIG. 3 is a side view of a product holder for application in the suspension system of FIG. 1.

Ball 12 can be formed integrally with product holder 10 and herein be manufactured from the same material, such as product holder 10 of FIG. 3, but a corrosion-resistant material is preferably applied for at least the ball, as is the case in FIGS. 1 and 2. Product holder 10 of FIGS. 1 and 2 herein comprises a brass ball 12 which is screwed onto shank 11 by means of a screw thread 16. By carrying this out at high temperature, the brass ball 12 will shrink onto shank 11 and not then be easily detached. The part of the product holder which slides reciprocally in the profiles and is thus most susceptible to wear therefore remains free of corrosion for a long period, so that the displaceability thereof in the profiles is not reduced in the course of time for this reason.

Figure 4:
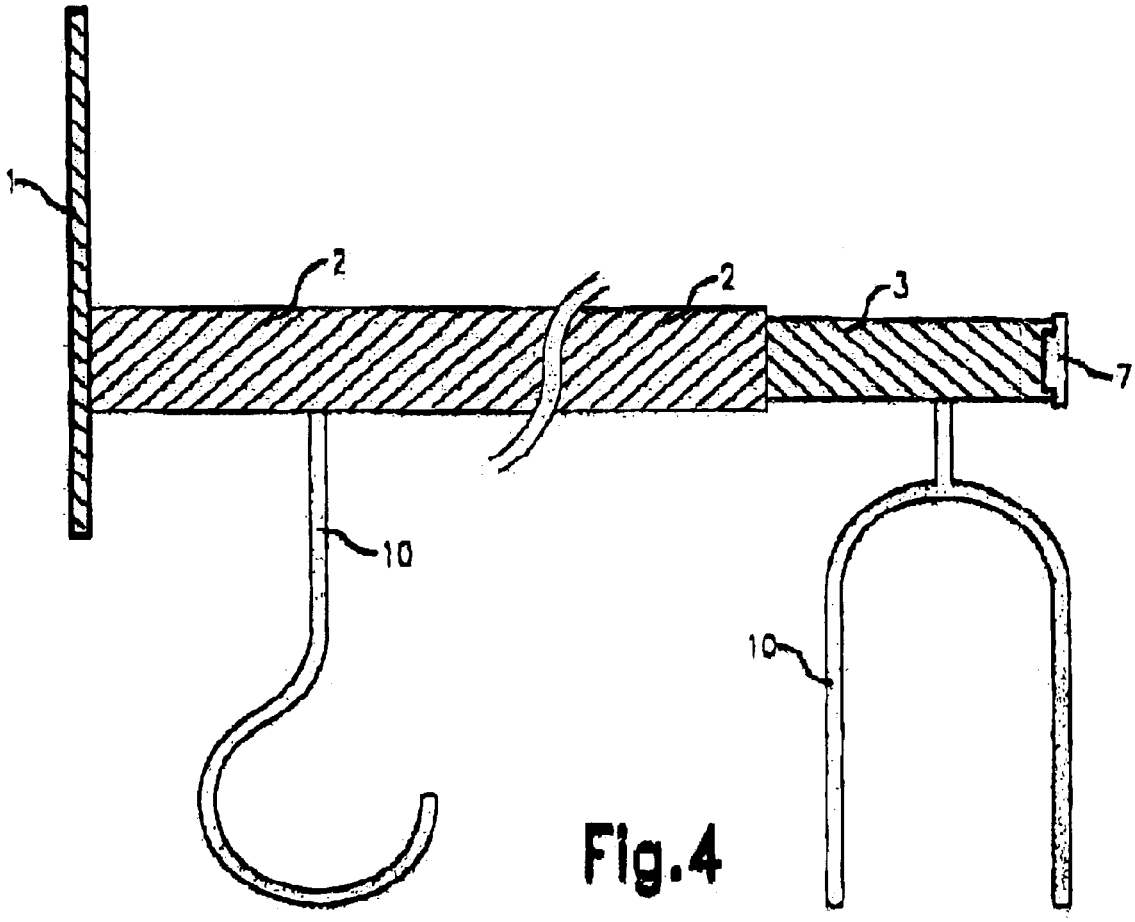
FIG. 4 is a side view of the suspension system of FIG. 1.

FIG. 4 shows clearly how both profiles 2,3 are telescopically extendable. In order to place respectively hang a tool such as a spade, garden rake and the like, the whole is extended so as to thus provide more space and better access. In this position the product holder can, if desired, be turned, whereafter the relevant tool can be removed or suspended. The whole is then pushed in again so as not to take up an unnecessarily large amount of space. In order to ensure that during displacement of a product holder the transition 8 between the two profiles 2,3 is not felt, or hardly so, the inner profile is chamfered on the edge of the slot 6 therein. An oblique edge 8 is thus obtained on which the ball 12 of product holders 10 can support at a level which does not differ, or hardly so, from the level in the outer profile. In preference a lubricant is further used in the profiles, such as grease or oil, although preferably a dry lubricant such as a silicone or Teflon coating. Product holders 10 will hereby run smoothly in profiles 2,3 and profiles 2,3 will also retract and extend smoothly relative to each other.

The invention thus provides a particularly convenient, handy and efficient suspension system for products. In this embodiment the wall plate has a width of about 10 centimeters and a height of about 15 centimeters. There will practically always be space for this on a wall of a room. The profiles are both about 50 centimeters long, with a virtually square cross-section of about 25 respectively 20 mm for the outer and inner profile. Such a profile assembly easily provides space for five to ten gardening tools, which can thus be put away neatly and individually accessible. Without the suspension system according to the invention considerably more space would be required for this purpose. An additional advantage of the suspension system therein is that it can be suspended at a height such that the floor remains clear. No useful floor area is thus lost.

Figure 5:
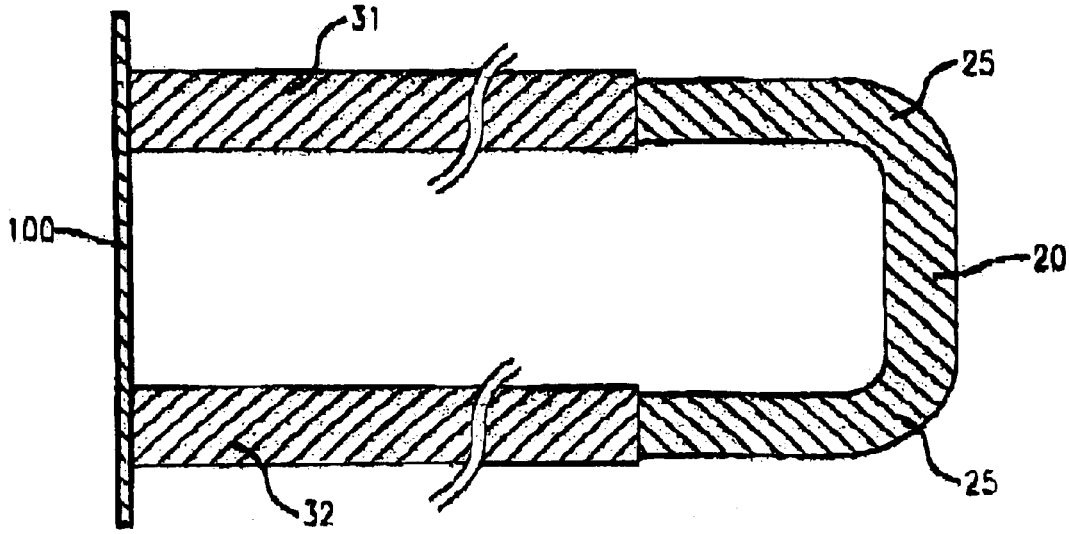
FIG. 5 is a top view of a second embodiment of the suspension system according to the invention.

A second embodiment of the suspension system according to the invention is shown in FIG. 5. The suspension system comprises in this case two mutually parallel outer profiles 31,32 of the type of the first embodiment in which an inner profile 20 is received telescopically in the same way as in the first embodiment. In this case however, the inner profile 2 forms a bend 25 mutually connected the two outer profiles 31,32. Product holders possibly having products suspended therefrom can thus slide freely from the one leg 31 to the other leg, and vice versa. The storage capacity of the system is hereby doubled while the protruding length remains the same. Furthermore, the suspension system thus does not protrude into the space with a comparatively sharp profile, but with a gently rounded tube bend 20, which enhances safety if the system is fixed at body or head height. With a view to this fixing, a wall plate 1 is also provided in this embodiment.

Although the invention has been further elucidated above with reference to only these two embodiments, it will be apparent that the invention is by no means limited to the given embodiments. On the contrary, many further variants and embodiments are possible for a person with ordinary skill in the art within the scope of the invention. The suspension system according to the invention is thus not limited to the hanging of household and gardening tools, but can also provide a solution in diverse situations and for different types of product for the storing of the products in compact but nevertheless individually accessible manner. The design and dimensions of the product holders can herein be adapted to the product te be received therein.

The measurements and materials given in the embodiments are all given by way of example, although other measurements and materials can be applied relatively freely instead. For a suspension system with a low weight and relatively low cost price it is possible to opt for instance to manufacture at least many of the components completely from plastic. In many cases the maximum load of such systems will then however be limited. A combination of plastics and metals can also be applied within the scope of the invention. The base can thus be manufactured for instance from metal in order to obtain a robust and relatively heavily loadable system, while the product holders are manufactured from plastic at low cost. Only the ball for instance of the product holders can for instance be manufactured from Teflon so as to obtain both corrosion-resistance and a low friction in the profile assembly.

Instead of coaxially mutually slidable profiles, profiles can also be applied which are slidable along each other or over each other. The product holders can moreover also slide for instance over the profiles instead of in the profiles. The suspension members of the product holders will in that case be modified accordingly. If desired, another type of suspension member can also be applied in the profile assembly instead of a ball, for instance one provided with wheels to which a shank of the suspension member is rotatably connected.

In short, the invention provides a wide variety of suspension systems for diverse types of product, which as a result of the invention can be suspended in compact but nevertheless individually accessible manner.

What is claimed is:

1. A suspension system for at least one product, the system comprising a base for fixing to a wall of a space, the base comprising at least two mutually telescopic profiles, each profile provided with a cavity extending axially therein and having a cross-section of at least practically the same shape as the profile, wherein one of the profiles is arranged to fit displaceably in the cavity of the other profile; and comprising at least one product holder which on a first side is connected displaceably to at least one of the profiles, which further comprise longitudinal slots that at least partly overlap each other and that provide access to the cavity, and on a second side comprises a suspension member which is able to receive a product, wherein the product holder protrudes with a shank through the longitudinal slot of at least one profile and on the first side comprises an anchoring member, which is displaceably anchored in the cavity of at least one profile and connected for rotation on a longitudinal axis, the anchoring member further comprising a ball situated on an end of the shank of the product holder and having a diameter greater than a width of the longitudinal slot.

2. A suspension system as claimed in claim 1, characterized in that the ball at least almost makes contact with at least two mutually opposite walls of the cavity.

3. A suspension system of claim 1 or 2, characterized in that at least the ball of the product holder is manufactured from corrosion-resistant material.

4. A suspension system as claimed in claim 1 or claim 2, characterized in that the longitudinal slot in at least one of the profiles comprises an oblique edge for receiving the ball of the product holder thereon.

5. A suspension system as claimed in claim 1 or claim 2, characterized in that the product holder comprises a shoulder from which depend two at least practically congruent hooks.

6. A suspension system as claimed in claim 5, characterized in that the shoulder and the hooks have a rounding with at least practically the same radius of curvature.

7. A suspension system as claimed in claim 1, wherein the product holder holds tools.

8. A suspension system as claimed in claim 7 wherein the tools are gardening tools.

* * * * *